United States Patent [19]

Sackenreuter et al.

[11] Patent Number: 5,001,963

[45] Date of Patent: Mar. 26, 1991

[54] DIFFERENTIAL PRESSURE PISTON-COMBUSTION CHAMBER FOR BARRELED WEAPONS

[75] Inventors: Hans Sackenreuter, Ruckersdorf; Gerhard Onderka, Nurnberg, both of Fed. Rep. of Germany

[73] Assignee: Diehl GmbH & Co., Nürnberg, Fed. Rep. of Germany

[21] Appl. No.: 700,938

[22] Filed: Oct. 9, 1984

[30] Foreign Application Priority Data

Oct. 12, 1983 [DE] Fed. Rep. of Germany ..... 33370648

[51] Int. Cl.[5] ..... F41F 1/04

[52] U.S. Cl. ..... 89/7; 89/11

[58] Field of Search ..... 89/7, 8, 11, 12, 13.05, 89/9

[56] References Cited

U.S. PATENT DOCUMENTS

| | | | |
|---|---|---|---|
| 3,763,739 | 10/1973 | Tassie | 89/7 |
| 4,033,224 | 7/1977 | Holtrop | 89/7 |
| 4,062,266 | 12/1977 | Elmore et al. | 89/11 X |
| 4,281,582 | 8/1981 | Jaqua | 89/7 |
| 4,341,147 | 7/1982 | Mayer | 89/7 |
| 4,523,508 | 6/1985 | Mayer et al. | 89/7 |

*Primary Examiner*—David H. Brown

*Attorney, Agent, or Firm*—Scully, Scott, Murphy & Presser

[57] ABSTRACT

A differential pressure piston-combustion chamber system for barreled or tube-firing weapons or guns with a regeneratively-actuated propellant injection device for the generation of propellant gases of liquid, in particular hypergolic propellant components. A differential pressure piston is arranged so as to be axially movably in the weapon housing coaxially relative to the weapon barrel, with the piston incorporating propellant infeed passageways as well as a loading piston which is in communication with filling passageways. In the cylindrical shaft of the differential pressure piston, there is concentrically arranged a charging piston which is movably axially relative thereto, where the free end is in communication with infeed passageways, and the differential pressure piston and the charging piston are provided with control rolls which, respectively, roll along as associated control cam track on a drum controller. Hereby, the drum controller, which is driven through an external gearing system, can be rotatably supported in concentricity with the charging piston in the weapon housing. Alternatively, the drum controller can be rotatably supported eccentrically relative to the differential pressure piston and the charging piston in the weapon housing.

6 Claims, 5 Drawing Sheets

GEHEIM

GEHEIM

GEHEIM

GEHEIM

DIFFERENTIAL PRESSURE PISTON-COMBUSTION CHAMBER FOR BARRELED WEAPONS

BACKGROUND OF THE INVENTION

1. Field of the Invention

The present invention relates to a differential pressure piston-combustion chamber system for barreled or tube-firing weapons or guns with a regeneratively-actuated propellant injection device for the generation of propellant gases from a liquid, in particular hypergolic propellant components, and with a differential pressure piston which is arranged so as to be axially movable in the weapon housing coaxially relative to the weapon barrel, with the piston incorporating propellant infeed passageways as well as a charging piston which is in communication with filling passageways.

2. Discussion of the Prior Art

Differential pressure piston-combustion chamber systems for barreled weapons or guns incorporating devices for the generation of propellant gases from hypergolic propellant components are presently known in the art. The essential advantages of barreled weapons or also of machine cannons with hypergolic liquid propellants in comparison with these with powder propellant charges, are the absence of a cartridge for receiving of the propellant charge, the absence of a detonating device, the liquid state condition of the propellant, the higher muzzle velocities of the projectiles, and the relatively low heating and erosion of the weapon barrel.

German Patent No. 17 28 074, as well as German Patent No. 17 28 077, each discloses barreled or tube-firing weapons or guns, in which the propellant injection is effected through the intermediary of a regeneratively actuated differential pressure piston. Whereas, in accordance with German Patent No. 17 28 074, the initiation of the injection and the firing is undertaken through an auxiliary injection arrangement, the aspiration of the propellant pursuant to German Patent No. 17 28 077 is implemented through a remote-controlled advance of the differential pressure piston, and the start of the injection and the through the remote-controlled return stroke of the differential pressure piston.

SUMMARY OF THE INVENTION

Accordingly, it is an object of the present invention to provide a differential pressure piston-combustion chamber system of the above-mentioned type, which is equipped with a technologically simple, effective suction and filling system for hypergolic propellant into the injection chambers at the head of the differential pressure piston.

The foregoing object is achieved pursuant to the present invention in that, in the cylindrical shaft of the differential pressure piston, there is concentrically arranged a charging piston which is movable axially relative thereto, whose free end is in communication with infeed passageways, and the differential pressure piston and the charging piston are provided with control rolls which, respectively, roll along an associated control cam track on a common drum controller. Hereby, the drum controller, which is driven through an external gearing system, can be rotatably supported in concentricity with the charging piston in the weapon housing. Alternatively, the drum controller can be rotatably supported eccentrically relative to the differential pressure piston and the charging piston in the weapon housing.

The neighboringly located control cam tracks, which extend annularly about the drum controller, for the loading piston and for the differential pressure piston, in the inventive embodiment, assume the same starting position at the beginning of charging and rise in parallel for the charging sequence in parallel whereby, during the return travel of the control cam track for the charging piston into the starting position, the control cam track of the differential pressure piston remains for so long at the reached height within a path until the control cam track of the charging piston has reached or almost reached the lower plane of the starting position, so as to thereupon again drop deeply back into its own starting position. This signifies that the control cam track for the charging piston will, within one operating cycle, slide the charging piston by means of the drum controller, aspirate propellant from a supply tank, move the charging piston back, and thereby pump the propellant behind the head of the differential pressure piston. Within the same operating cycle, on the second control cam track, the differential pressure piston is slid forwardly by means of the drum controller in synchronism with the charging piston. While the charging piston is moved back, the differential pressure piston is pressed forwardly during the second phase of the movement, and only shortly prior to reaching of the control cam track starting position, after effected hypergolic ignition and regenerative propulsion, is it returned extremely rapidly, which corresponds to a rapid piston recoil. Hereby, pursuant to the invention, the differential pressure piston and the charging piston are forcibly moved axially in an optimum manner by means of the cam control arrangement, such that the suctioning and injection sequences regularly occur at precisely predetermined points in time. Just this forcible control will advantageously exert itself for rapid fire weapons or high output machine cannons, inasmuch as this will avoid errors in control and thereby erroneous ignition.

Pursuant to an inventive modification, the control cam track for the differential pressure piston, for the setting of differently long ignition delay periods, can have its upper cam track contour describe a downward curve and its lower cam track contour describe an upward curve, and thereby achieve a braking of the differential pressure piston.

Pursuant to an inventive modification, the charging piston can include a central infeed passageway which extends along its longitudinal axis, with a valve preventing any backflow, and which is connected with a suctioning passageway through a filling chamber arranged at the shaft end in the weapon housing, whereas a filling chamber for the second propellant component, which is arranged essentially annually about the central filling chamber, communicates with an externally located infeed passageway extending in parallel with the longitudinal axis of the charging piston. The length of the filling chamber, as measured along the longitudinal axis of the charging piston, can be equal to or shorter than the moving space for the axial movement of the differential pressure piston and the charging piston.

In lieu of a common drum controller, there can be selectively provided for every control roll its own drum controllers with control cam tracks which are actuated in synchronism with each other for effecting the rotational movement.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
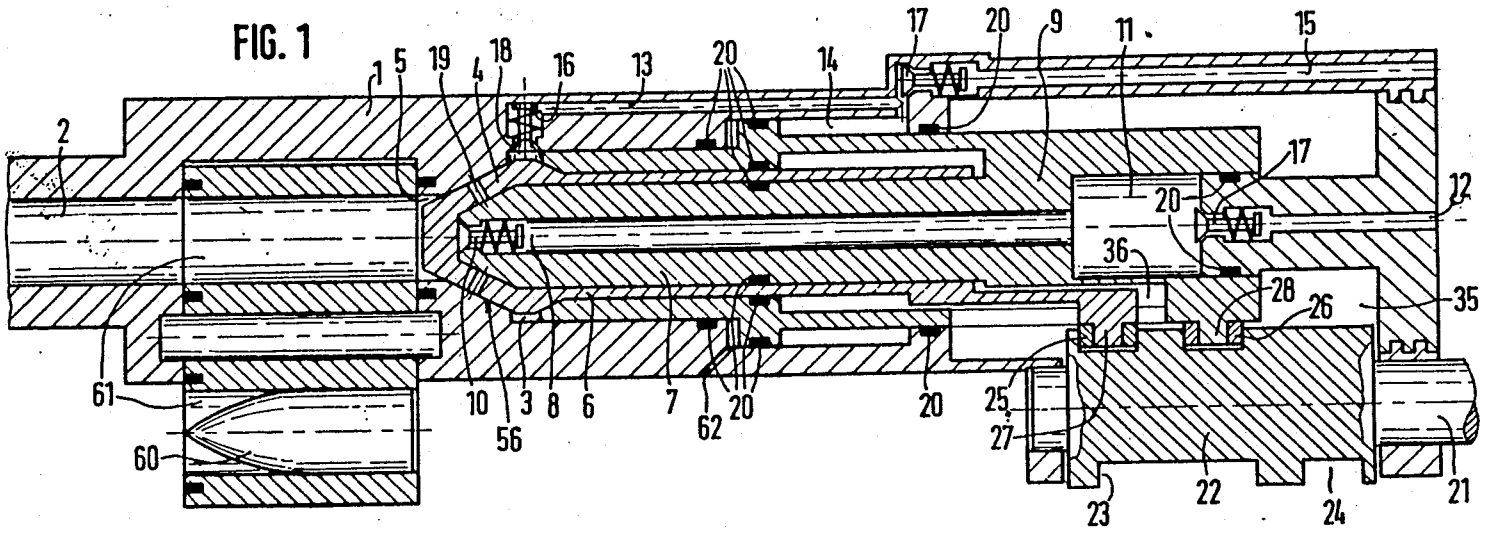
FIG. 1 illustrates in a longitudinal section view, a schematic representation of the differential pressure piston with cam control during the charging sequence.

Arranged in a weapon housing 1 of a barreled weapon or gun (not shown in detail) is a differential pressure piston 4 which is axially movable in a bore 3 extending coaxial with the bore axis of the weapon barrel 2. The forward portion of the bore 3 which is open towards the weapon barrel 2 forms the combustion chamber 5 which, extending from the weapon barrel 2, widens conically at a relatively low angle. Supported concentrically in the hollow-cylindrical shaft 6 of the differential pressure piston 4 is a charging piston 7 so as to be axially movable relative thereto. The charging piston 7 includes an infeed passageway 8 along its longitudinal axis for the first propellant component, for example, the oxidizer. The infeed passageway 8 is equipped with a non-return valve 10, and is in communication with a filling chamber 11 which is formed at the shaft end 9 of the charging piston 7 in the weapon housing 1, whose suctioning passageway 12 is connected to the propellant supply tank. The infeed passageway 13 for the second propellant component, the fuel, is located radially outwardly of the charging piston 7 externally of the shaft 6 of the differential pressure piston 4. This infeed passageway 13 communicates with a filling chamber 14 in the weapon housing 1 and is arranged so as to extend annually about the filling chamber 11, and whose suctioning passageway 15 leads to the tank container for the fuel. In the infeed passageway 13, as well as in the suctioning passageways 12 and 15, there are inserted non-return valves 16, 17, in order to prevent an undesired backflow of the propellants.

The fuel is injected into the combustion chamber 5 through externally located nozzles 18 in the weapon housing 1 near the head end of the differential pressure piston 4, and the oxidizer through internal passageways 19 in the head, wherein the injection sequence is effected through the axial movement of the differential pressure piston 4. Sealing means 20 are provided between the components which move relative to each other and axially, so as to thereby avoid an inflow of liquids into the neighboring spaces.

A drum controller 22 is supported in the weapon housing 1 in an eccentric arrangement relative to the differential pressure piston 4 or the charging piston 7, and is set into rotation through a drive shaft 21. The drum controller 22 possesses control cam tracks 23 and 24 into which engage control rolls 25 and 26. The control roll 25 is supported on the control trunnion 27 and is fixedly connected with the shaft 6 of the differential pressure piston 4. It engages into the control cam track 23. The control roll 26 on the control trunnion 28, in contrast therewith, is fixedly attached to the charging piston 7 and is guided in the control cam track 24. The rotational movement of the drum controller 22 causes an axial movement of the differential pressure piston 4 and the charging piston 7 relative to each other which is postively controlled.

Figure 2:
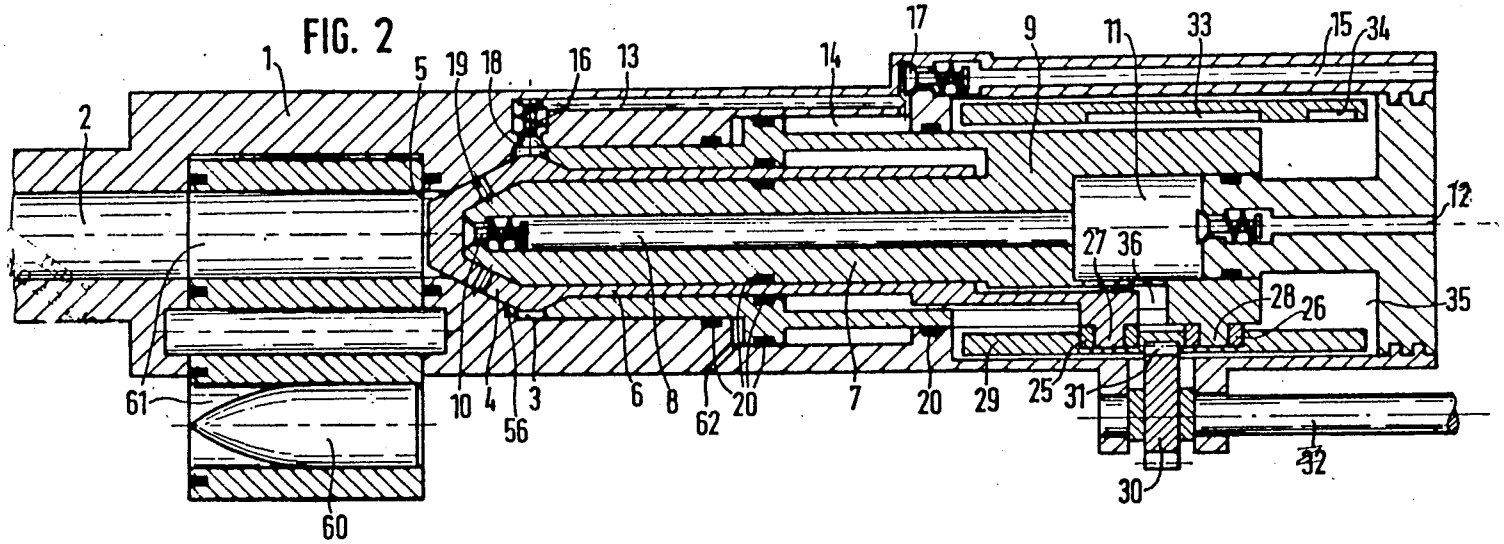
FIG. 2 illustrates a schematic representation of the differential pressure piston with a concentrically arranged drum controller.

As an alternative to the eccentric support of the drum controller 22, it is also possible to provide a concentric support as is illustrated in FIG. 2. Herein, within the weapon housing 1, the drum roller 29 is constructed hollow-cylindrically and rotatably supported, concentrically with to the charging piston 7. The drum controller 29 is in operative connection with a drive wheel 30 through a ring gear 31. The drive wheel 30 is, in turn, rotated by the control shaft 32. Within the drum controller 29 there is provided in the inner ring a control cam track 33 for engagement by the cam roll 25 with the differential pressure piston and control cam track 34 for the control roll 26 of the charging piston 7. The axial moving space 35 for the charging piston 7 essentially corresponds to the moving space 36 for the differential pressure piston 4. Both moving spaces 35, 36 are presently approximately of the same length or shorter than the axial length of the filling chamber 14 or irrespectively, the filling chamber 11.

Figure 5:
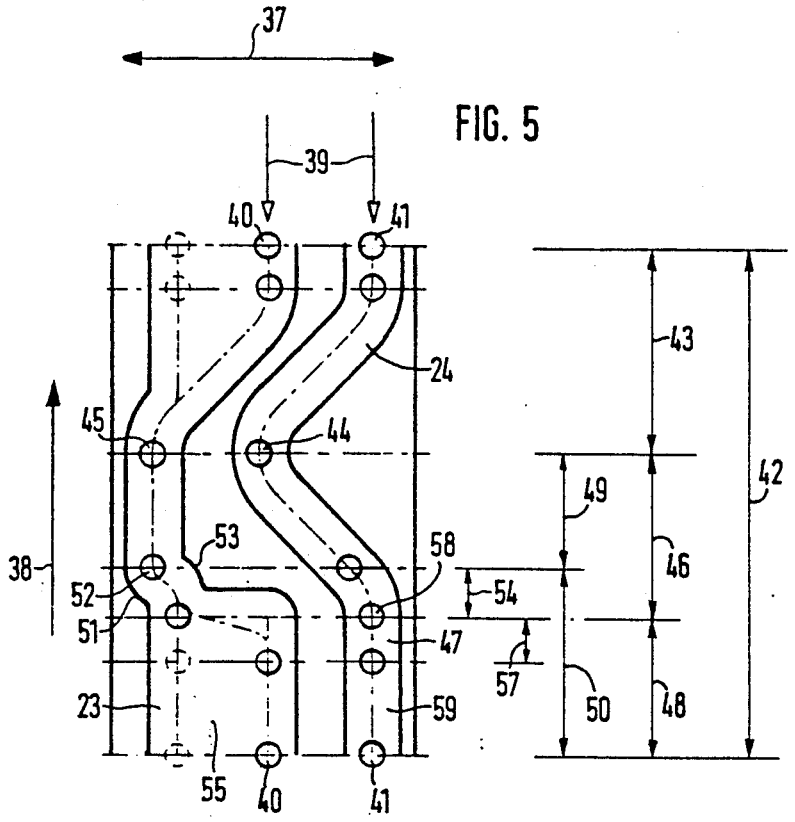
FIG. 5 illustrates the development in a plane of the control cam tracks on the drum controller.

The control cam tracks 23, 24 and 33, 34 naturally have presently the same course and can be ascertained especially from FIG. 5. For purposes of simplicity, and in order to provide a better overview, shown in FIG. 5 are only the control cam tracks 23, 24. The absolute directions of movement of the control rolls 25 and 26 is illustrated by the double-headed arrow 37, whereas the arrow 38 illustrates the absolute direction of movement of the control roll 22. The arrows 39 indicate the relative movement of the control rolls 25, 26 with respect to the control cam tracks 23, 24. Both control cam tracks 23 and 24 are located at a spacing adjacent each other and possess the same starting position 40, 41.

FIG. 5 presently illustrates an operating cycle of the control cam tracks along the distance 42. Both cam tracks 23, 24 continually rise in parallel over the distance 43 for the propellant suctioning up to the respective maximum points 44 and 45. The control cam track 24 of the charging piston 7 drops off uniformly after the point 44 over the distance 46 representing the infeed of the propellants into the plane 47 of the starting position 41 and then continues along a linear path 48. The control cam track 23 for the differential pressure piston 4, after reaching of the maximum point 45, remains at the reached height through the distance 49, until the control cam track 24 has almost reached its lower plane 47. Thereafter, the control cam track 23 drops off steeply over the distance 54.

In order to achieve an adjustment of the possible, differently lengthy ignition delay periods, which can be effected through the different propellant components, the upper contour 51 of the control cam track 23 for the differential pressure piston 4 extends in a downward curve commencing from the position 52 in order to return the differential pressure piston 4 into the starting position 40. The lower contour 53 of the control cam track 23 in contrast therewith has an upward curve in the same region which causes the differential pressure piston 4 to be brought to a standstill within this phase.

Within this short distance 54, the ignition delay period, the piston 4 is braked, wherein, after the effected ignition, it will return accelerated into the starting position 40. In this last region 55, the control cam track 23 can assume the width between the ignition and the start.

Within the distance 49 the differential pressure piston is pressed forwardly against the sealing cone 56. The distance 54 is synonymous with the period of the remote-controlled injection, whereas the distance 57 represents the time for the regeneratively-operated injection.

FIGS. 1 and 2 illustrate the differential pressure piston-combustion chamber in the position of the charging sequence. In this position, the drum controller 26 has traversed the distance 43 in the rotating control cam roll 22 and 29. The charging piston 7 is skid forwardly and suctions propellant into the filling chamber 11 or, respectively, the filling chamber 14. Concurrent, the control roll 25 has traversed the distance 43 in the control cam track 23 (33), whereby the differential pressure piston 4 has also been slid forwardly. The now reached position is at point 44 and 45.

Figure 3:
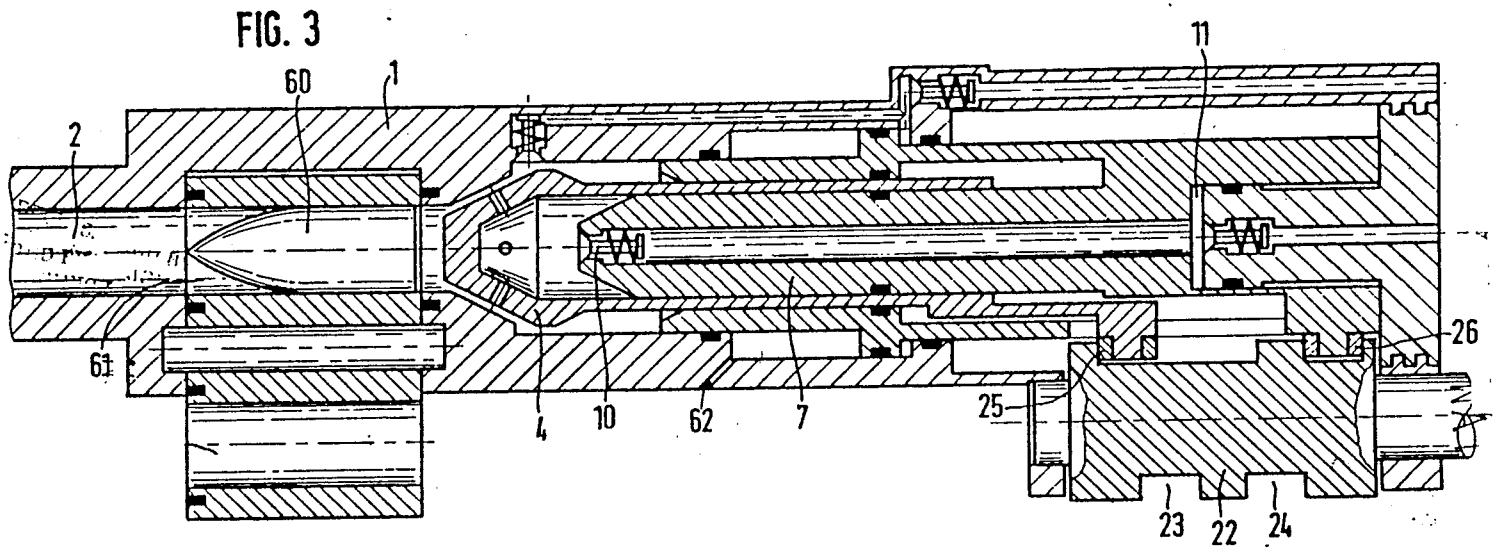
FIG. 3 illustrates a longitudinal sectional view through the differential pressure piston of FIG. 1 during the ignition time point.

The point in time of the ignition is illustrated in FIG. 3. This is effected when the control roll 26 has traversed the path 46 in the control cam track 24 (34) and has reached point 58. This return movement is not followed by the control roll 25 for the differential pressure piston 4. It remains at the reached height up to about point 41, at which the control roll 26 of the charging piston 7 has almost reached the plane 47. During the movement of the control roll 25 up to the point 52, the differential pressure piston 4 is pressed forwardly. During this time, in accordance with uniformly dropping control cam track 24, the charging piston 7 has been pulled back and thus has pumped propellant behind the head of the differential pressure piston 4.

Figure 4:
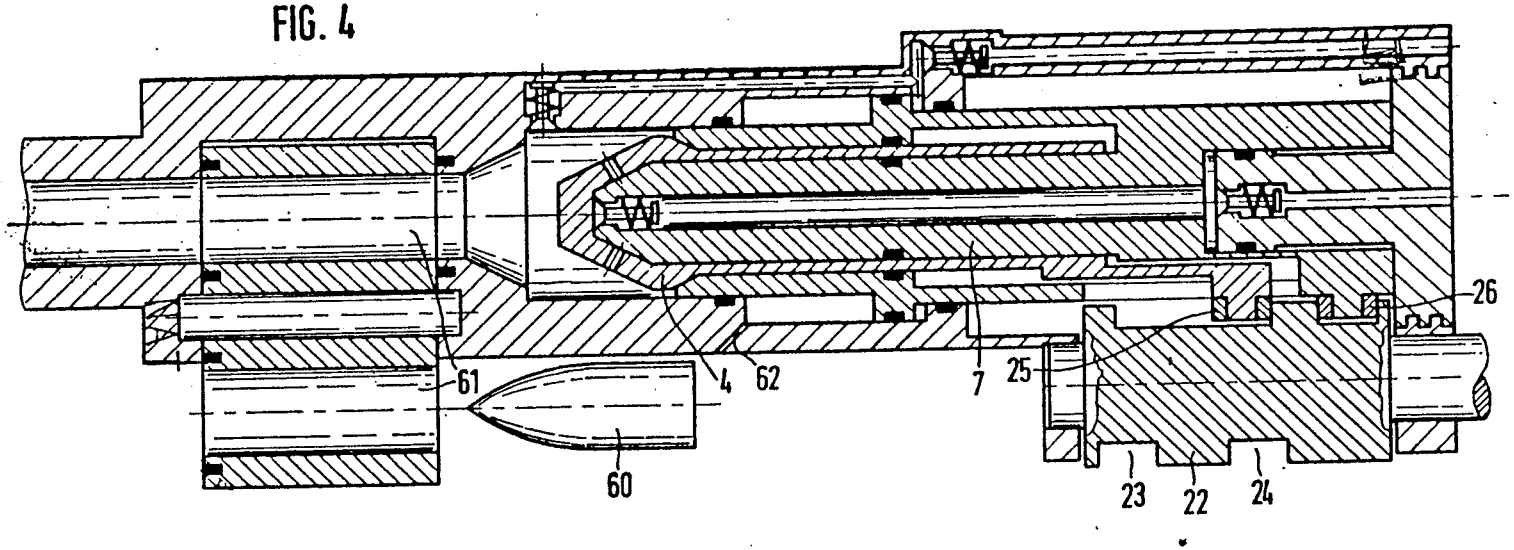
FIG. 4 illustrates a longitudinal section view through the differential pressure piston of FIG. 1 subsequent to effected firing.

FIG. 4 illustrates the situation subsequent to firing. The control roll 26 is returned in control cam track along the path 59 into the starting position 41. The control curve 23 drops off steeply from point 57 into the starting position 40, which signifies that the differential pressure piston 4, after hypergolic ignition and regenerative propulsion, has an extremely rapid return movement.

Reference numeral 60 schematically illustrates projectiles which are inserted into projectile magazines 61 and which are conveyed to the weapon barrel 2 in the pregiven synchronism with the control roll 22 and 29.

Reference numeral 62 designates a venting passageway.

What is claimed is:

1. In a differential pressure piston-combustion chamber system for barreled or tube-firing weapons; regeneratively-actuated propellant injection means for the generation of propellant gases from liquid, particularly hypergolic propellant components; an axially movable differential pressure piston extending in a weapon housing coaxially with the weapon barrel and including propellant infeed passageways; and a charging piston communicating with filling passageways and suctioning passageways; said differential pressure piston including a cylindrical shaft, said charging piston being concentrically located in said cylindrical shaft for axial movement relative thereto; and a control arrangement having said differential pressure piston and said charging piston connected thereto for controlling said axial movement; the improvement comprising said control arrangement including control rolls connected with said differential pressure piston and said charging piston; a controller drum having adjacently located, annular cam tracks, said control rolls commonly rolling in said cam tracks, which assume the same starting positions at the start of the charging for the differential pressure piston and the charging piston and extend under the same rising angle in parallel for the starting cycle up to an applicable rise, wherein the control cam track for the charging piston is reconveyed into the starting position from the attained rise under the same rising angle, and the control cam track for the differential pressure piston, which in the region of detonation up to the starting position, remains maintained in full width over the path of movement of the controller drum, is conveyed further at a zero rising angle for so long until the control cam track for the charging piston has reached the plane of the starting position, so as to thereupon fall back into its own starting position under a rising angle of almost 90°, wherein the control cam track of the differential pressure piston, for the setting of differently lengthy detonating delay periods, subtends a downward arc with its upper cam track contour and upward arc with its lower cam track contour along the relatively short path of movement of the controller drum.

2. A differential pressure piston-combustion chamber system as claimed in claim 10, wherein the drum controller is rotatably supported in the weapon housing eccentrically relative to the differential pressure piston and the charging piston.

3. A differential pressure piston-combustion chamber system as claimed in claim 10, wherein the drum controller is rotatably supported concentrically relative to the charging piston in the weapon housing; and external gear means for driving said drum controller.

4. A differential pressure piston-combustion chamber system as claimed in claim 1, wherein the charging piston includes a central infeed passageway extending along its longitudinal axis; a non-return valve in said passageway located at the shaft end thereof in the weapon housing with a suctioning passageway; and a filling chamber for the second propellant component which extends annularly about the central filling chamber being connected with an externally located infeed passageway oriented substantially in parallel with the longitudinal axis of the charging piston.

5. A differential pressure piston-combustion chamber system as claimed in claim 1, wherein the length of the filling chamber measured along the longitudinal axis of the charging piston is equal to or shorter than the moving space for the axial movement of the charging piston.

6. A differential pressure piston-combustion chamber system as claimed in claim 1, wherein separate drum controllers are provided for each respective control roll, said drum controllers being actuated in synchronism with each other.

* * * * *

UNITED STATES PATENT AND TRADEMARK OFFICE

CERTIFICATE OF CORRECTION

PATENT NO. : 5,001,963

DATED : March 26, 1991

INVENTOR(S) : Hans Sackenreuter, et. al.

It is certified that error appears in the above-identified patent and that said Letters Patent is hereby corrected as shown below:

Column 6, line 32, Claim 2: "claim 10" should read as --claim 1--

Column 6, line 37, Claim 3: "claim 10" should read as --claim 1--

Signed and Sealed this

Fifteenth Day of December, 1992

*Attest:*

DOUGLAS B. COMER

*Attesting Officer*

*Acting Commissioner of Patents and Trademarks*